US006038822A

United States Patent [19]

Keys

[11] Patent Number: 6,038,822

[45] Date of Patent: Mar. 21, 2000

[54] OCTAGONAL SHAPED CONCRETE BLOCK

[76] Inventor: Clyde James Keys, 876 Ranch Rd., Tarpon Springs, Fla. 34689

[21] Appl. No.: 09/018,237

[22] Filed: Feb. 3, 1998

[51] Int. Cl.[7] ..... E04B 1/04

[52] U.S. Cl. ..... 52/100; 52/98; 52/606; 52/608; 52/609

[58] Field of Search ..... 52/98, 100, 606, 52/608, 609, 742.14

[56] References Cited

U.S. PATENT DOCUMENTS

| | | | |
|---|---|---|---|
| 1,649,367 | 11/1927 | Reagan | 52/606 |
| 3,936,987 | 2/1976 | Calvin . | |
| 4,128,357 | 12/1978 | Barth et al. . | |
| 4,227,357 | 10/1980 | Newsom . | |
| 4,426,176 | 1/1984 | Terada . | |
| 4,651,486 | 3/1987 | Erickson et al. . | |
| 5,058,357 | 10/1991 | Newsom . | |
| 5,484,236 | 1/1996 | Gravier . | |
| 5,490,363 | 2/1996 | Woolford | 52/606 X |
| 5,513,475 | 5/1996 | Schaaf et al. . | |
| 5,556,228 | 9/1996 | Smith . | |
| 5,560,171 | 10/1996 | McCoy . | |
| 5,598,679 | 2/1997 | Orton et al. . | |
| 5,634,313 | 6/1997 | Mogling . | |
| 5,667,200 | 9/1997 | Kelley, Jr. . | |

*Primary Examiner*—Christopher T. Kent
*Attorney, Agent, or Firm*—Stein, Schifino & Van Der Wall

[57] ABSTRACT

Construction blocks having a generally octagonal configuration. The octagonal shape is defined by first through eighth external side portions respectively connected end-to-end to define an octagonal shape with respective first through eighth corners; a transverse chord portion extending from said first corner to said fourth corner; a perpendicular segment portion extending perpendicularly from said transverse chord portion to said third corner defining a right angled cutout; an angled segment portion extending from said second corner to said transverse chord portion defining a triangle cutout; and a middle cutout defined by said triangle cutout, said right angle cutout and said transverse cord portion.

9 Claims, 7 Drawing Sheets

OCTAGONAL SHAPED CONCRETE BLOCK

BACKGROUND OF THE INVENTION

1. Field of the Invention

This invention relates to concrete blocks used for constructing readily and inexpensively angled or straight walls for buildings and the like.

2. Description of the Background Art

Historically, man has created structures from masonary blocks. This form of building traces its ancestry from the earliest structures which were piles of rock to contemporary cut stone systems and from sun baked brick to the contemporary trend of utilizing kin fired bricks and cast cement blocks.

Representative construction blocks are described and illustrated in U.S. Pat. Nos. 3,936,987; 4,426,176; 4,227,357; 5,058,357 and 5,513,475 the disclosures of which are hereby incorporated by reference herein.

There are many various building blocks in use today which are manufactured primarily from cementitious materials. Many of these blocks have been developed with configurations having essentially the same outside surface, that is rectangular block. A standard cement block is rectangular in shape and has two openings with a solid web transversing between the two openings. The standard width of said rectangular block being 7⅝ inches. The standard length of said rectangular block being 15⅝ inches. The standard width of said web portion of said rectangular block being 1 inch. The standard wall thickness of said rectangular block being 1¼ inches.

Concrete rectangular blocks are the chosen form of building material due to their cost. In fact, the only building material which is lower in cost is wood. However, wood frame construction is not as sturdy as the block construction. Furthermore, the wooden structure is prone to fire and insect damage and it requires constant maintenance to prevent deterioration.

Presently, when rectangular cement blocks are used to fabricate walls, the aesthetics of the wall leave much to be desired, in that essentially only a straight linear wall with a vertical surface is created. Generally, only 90° corners can be used if a turn in the wall is required. Other walls of various angles can be constructed by cutting the corners of the rectangular block to match the desired angle. However, this technique is very time consuming in that it requires a skilled mason to cut each and every block at the desired angle. In addition, boards must be accurately placed against the cut blocks to allow the cut cement block to be back filled with poured concrete.

It is well known that structures utilizing masonary techniques have become increasingly costly due to the labor and energy involved in construction. Masonary items such as brick, cut stone or concrete block require skilled masons to lay up the building blocks. These skilled masons are costly due to the amount of time it may take to properly lay up the building materials to acquire the final aesthetic style.

Therefore, it is an object of this invention to provide an improvement which overcomes the aforementioned inadequacies of the prior art and provides an improvement which is a significant contribution to the advancement of the concrete block art.

In view of the obvious shortcomings of the various contemporary building methods, it is an object of this invention to provide a building block which may be laid up in a shorter period of time by a skilled mason thereby allowing a cost savings.

An additional object of the present invention is to provide a multifaceted shaped concrete block as an integral unit.

Another object of the present invention is to provide an octagonal shaped concrete block as an integral unit.

Still another object of the present invention is to provide an octagonal shaped concrete block as an integral unit having side portions of equal length and wherein said side portions are positioned at an angle of 135 degrees to each other.

Another object of the present invention is to provide an octagonal shaped concrete block that is cast as an integral unit allowing standard concrete blocks to be adjoined to said octagonal block at angles of 0°, 45°, 90°, 135°, 180°, 225°, 270°, and 315°.

Still another object of the present invention is to provide an octagonal shaped concrete block that is cast as an integral unit and thereafter can be quickly and accurately broken to produce side wall angles of 45°, 90°, 135°, and 180° for an improved aesthetic appearance of walls that are attached to said octagonal block.

Still another object of the present invention is to provide an octagonal shaped concrete block that is cast as an integral unit having a uniform wall thickness throughout.

Another object of the present invention is to provide an octagonal shaped concrete block that is cast as an integral unit having at least one break away point to allow a skilled mason to quickly and accurately break away the desired part of the octagonal block to produce the desired aesthetic angle.

Yet another object of the present invention is to provide a method for forming an octagonal building block, comprising:

providing a block forming mold with a bottom, side and external walls; said external walls having an octagonal shape; providing an octagonal shaped internal wall positioned at a fixed distance and matching the angularity of said external walls of said block forming mold; providing a channel integrally connected and positioned between said internal and said external walls; filling said channel of said block forming mold with concrete; allowing said concrete block to harden into a concrete block; separating said channel, said interior walls and said exterior walls from the concrete block.

A still further object of this invention is to provide an octagonal block comprising:

first through eighth external side portions respectively connected end-to-end to define an octagonal shape with respective first through eighth corners; a transverse chord portion extending from said first corner to said fourth corner; a perpendicular segment portion extending perpendicularly from said transverse chord portion to said third corner defining a right angled cutout; an angled segment portion extending from said second corner to said transverse chord portion defining a triangle cutout; and a middle cutout defined by said triangle cutout, said right angle cutout and said transverse cord portion.

The foregoing has outlined some of the pertinent objects of the invention. These objects should be construed to be merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention and the detailed description of the preferred embodiment in addition to the scope of the invention defined by the claims taken in conjunction with the accompanying drawings.

SUMMARY OF THE INVENTION

For the purpose of summarizing this invention, this invention comprises an octagonal construction block for use in the construction of buildings to quickly and accurately construct angled walls therefrom. More particularly, the construction blocks of this invention comprises first through eighth external side portions respectively connected end-to-end to define an octagonal shape with respective first through eighth corners. A transverse chord portion extending from said first corner to said fourth corner. A perpendicular segment portion extending perpendicularly from said transverse chord portion to said third corner defining a right angled cutout. An angled segment portion extending from said second corner to said transverse chord portion defining a triangle cutout. A middle cutout defined by said triangle cutout, said right angle cutout and said transverse cord portion.

The present invention provides an octagonal building block which allows a skilled mason to precisely, in a reduced period of time, form 45°, 90°, 135° and 180° surfaces along the outer surface of the octagonal building block by:

securing an octagonal building block having: first through eighth external side portions respectively connected end-to-end to define an octagonal shape with respective first through eighth corners; a transverse chord portion extending from said first corner to said fourth corner; a perpendicular segment portion extending perpendicularly from said transverse chord portion to said third corner defining a right angled cutout; an angled segment portion extending from said second corner to said transverse chord portion defining a triangle cutout; and a middle cutout defined by said triangle cutout, said right angle cutout and said transverse cord portion;

knocking on the chosen break away point;

removing displaced concrete material to expose the chosen angled exterior surface;

placing a wall or another block against the respective chosen angled exterior surface; and securing said wall or said block against said respective exposed surface.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

DETAILED DESCRIPTION OF THE PREFERRED EMBODIMENT

Figure 1C:
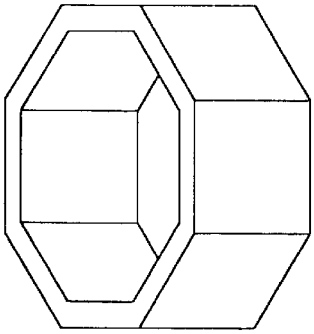
FIG. 1C is a perspective view of the first embodiment of the octagonal building block of the present invention illustrating the eight sides of the block.
Figure 1A:
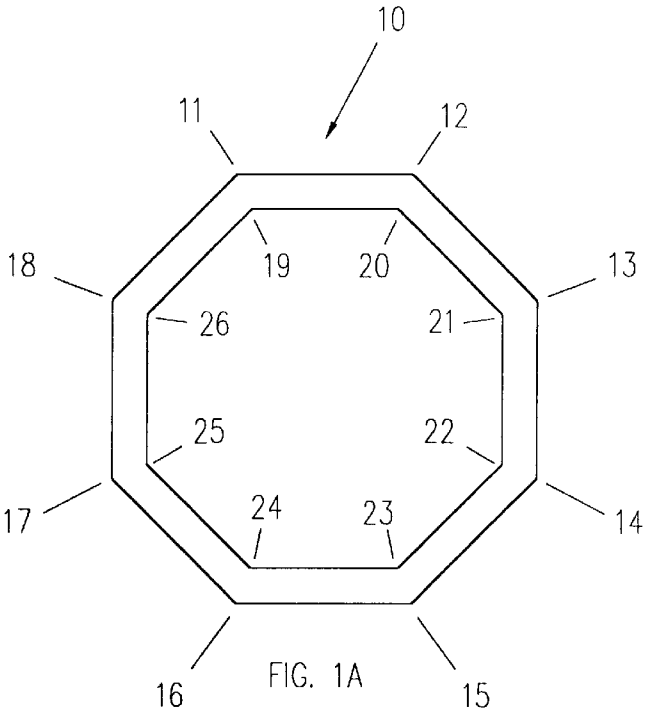
FIG. 1A is a top view of the first embodiment of the octagonal building block of the present invention illustrating the eight sides of the block.
Figure 1B:
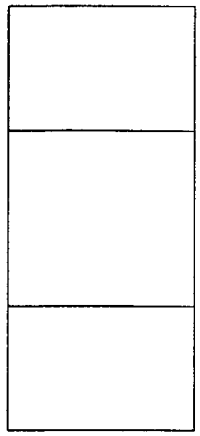
FIG. 1B is a side view of the first embodiment of the octagonal building block of the present invention illustrating the eight sides of the block.

Referring to FIG. 1A, the first embodiment of the octagonal building block 10 of the invention comprises first through eighth external side portions respectively connected end-to-end to define an octagonal shape with respective first through eighth corners respectively numbered 11 through 18; eight internal surface portions respectively connected end-to-end to define an octagonal shape respectively numbered 19 through 26.

Figure 2:
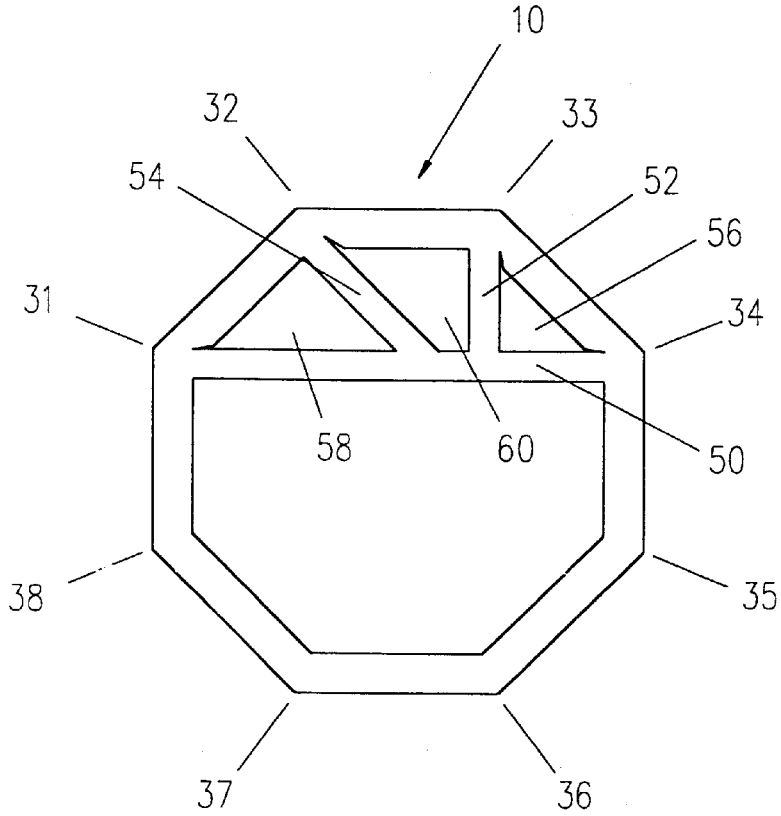
FIG. 2 is a top view of the second embodiment of the octagonal building block of the present invention illustrating the eight sides of the block and the layout of the internal portions.

The second embodiment of the octagonal building block 10 of the invention as shown in FIG. 2, comprises first through eighth external side portions respectively connected end-to-end to define an octagonal shape with respective first through eighth corners respectively numbered 31 through 38; a transverse chord portion 50 extending from said first corner 31 to said fourth corner 34; a perpendicular segment portion 52 extending perpendicularly from said transverse chord portion 50 to said third corner 33 defining a right angle cutout 56; an angled segment portion 54 extending from said second corner 32 to said transverse chord portion 50 defining a triangle cutout 58; and a middle cutout 60 defined by said triangle cutout 58, said right angle cutout 56 and said transverse cord portion 50.

Figure 3A:
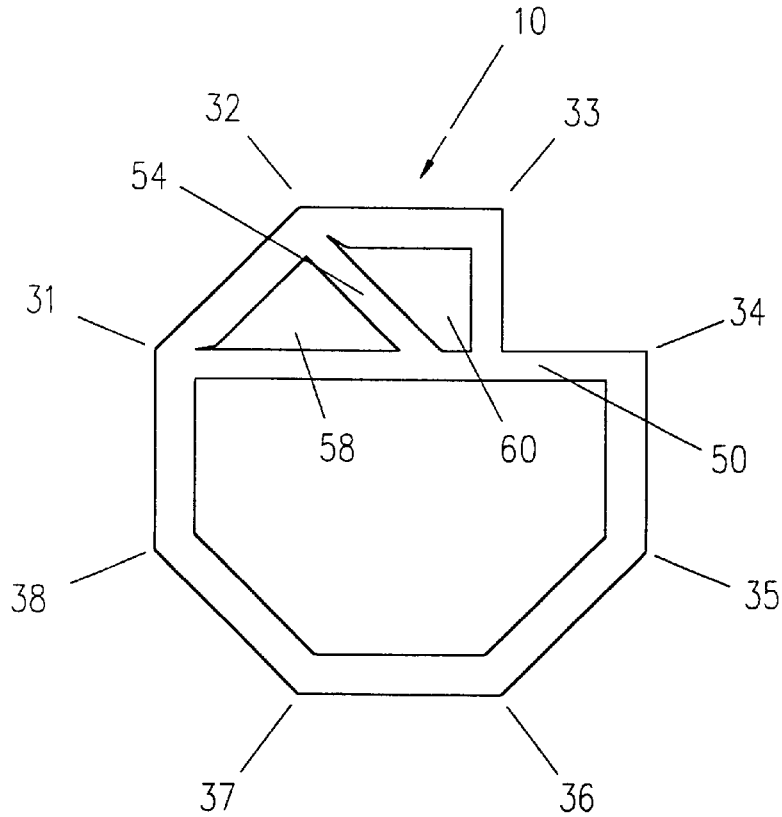
FIG. 3A is a top view of the octagonal building block illustrating the block after the removal of the right angle cutout to form a 90° surface.

As shown in FIG. 3A, octagonal building block 10 has had right angle cutout 56 removed to expose perpendicular segment portion 52 thereby creating a 90° surface between said third corner 33 and said fourth corner 34 allowing the placement of standard block at a 90° angle and the construction of a wall at a 90° angle.

Figure 3B:
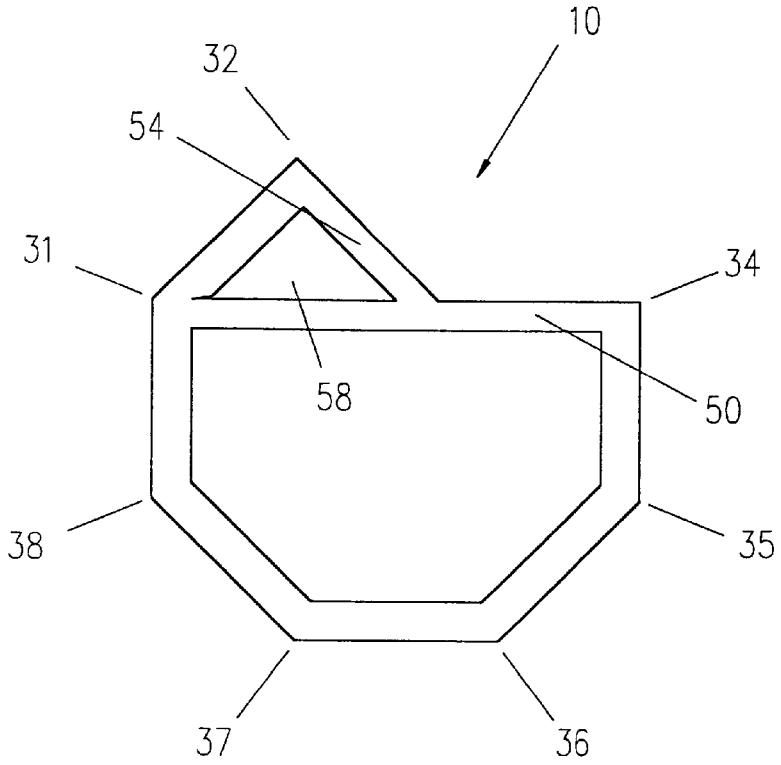
FIG. 3B is a top view of the octagonal building block illustrating the block after the removal of the right angle cutout and the middle cutout to form a 135° surface.

As shown in FIG. 3B, octagonal building block 10 has had right angle cutout 56 removed and middle cutout 60 removed to expose angled segment portion 54 thereby creating a 135° surface between said second corner 32 and said fourth corner 34 allowing the placement of standard block at a 135° angle and the construction of a wall at a 135° angle.

Figure 3C:
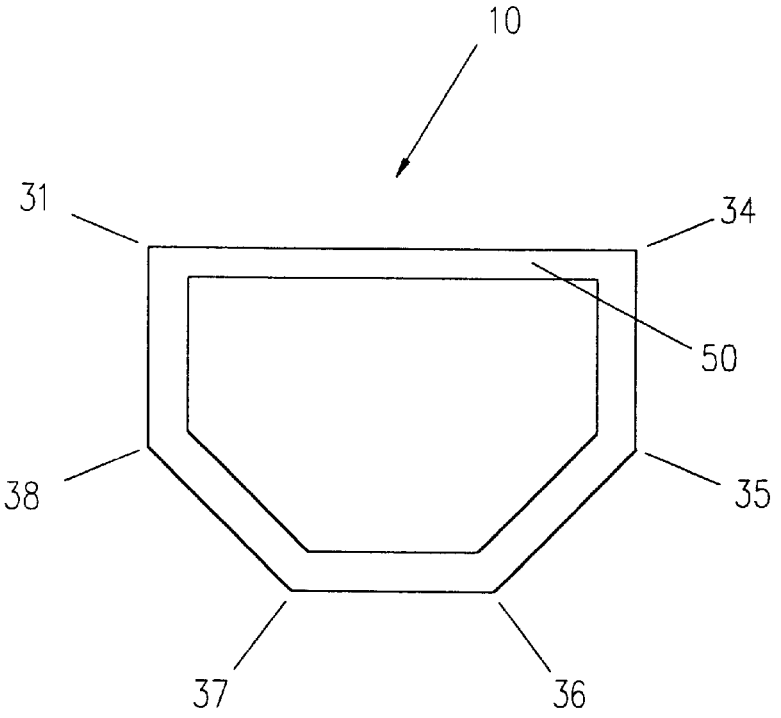
FIG 3C is a top view of the octagonal building block illustrating the block after the removal of the right angle cutout, the middle cutout, and the triangle cutout to form a 180° surface.

As shown in FIG. 3C, octagonal building block 10 has had right angle cutout 56 removed, middle cutout 60 removed, and triangle cutout 58 removed to expose transverse cord segment portion 50 thereby creating a 180° surface between said first corner 31 and said fourth corner 34 allowing the placement of standard block at a 180° angle and the construction of a wall at a 180° angle.

Figures 4A, 4B, 4C:
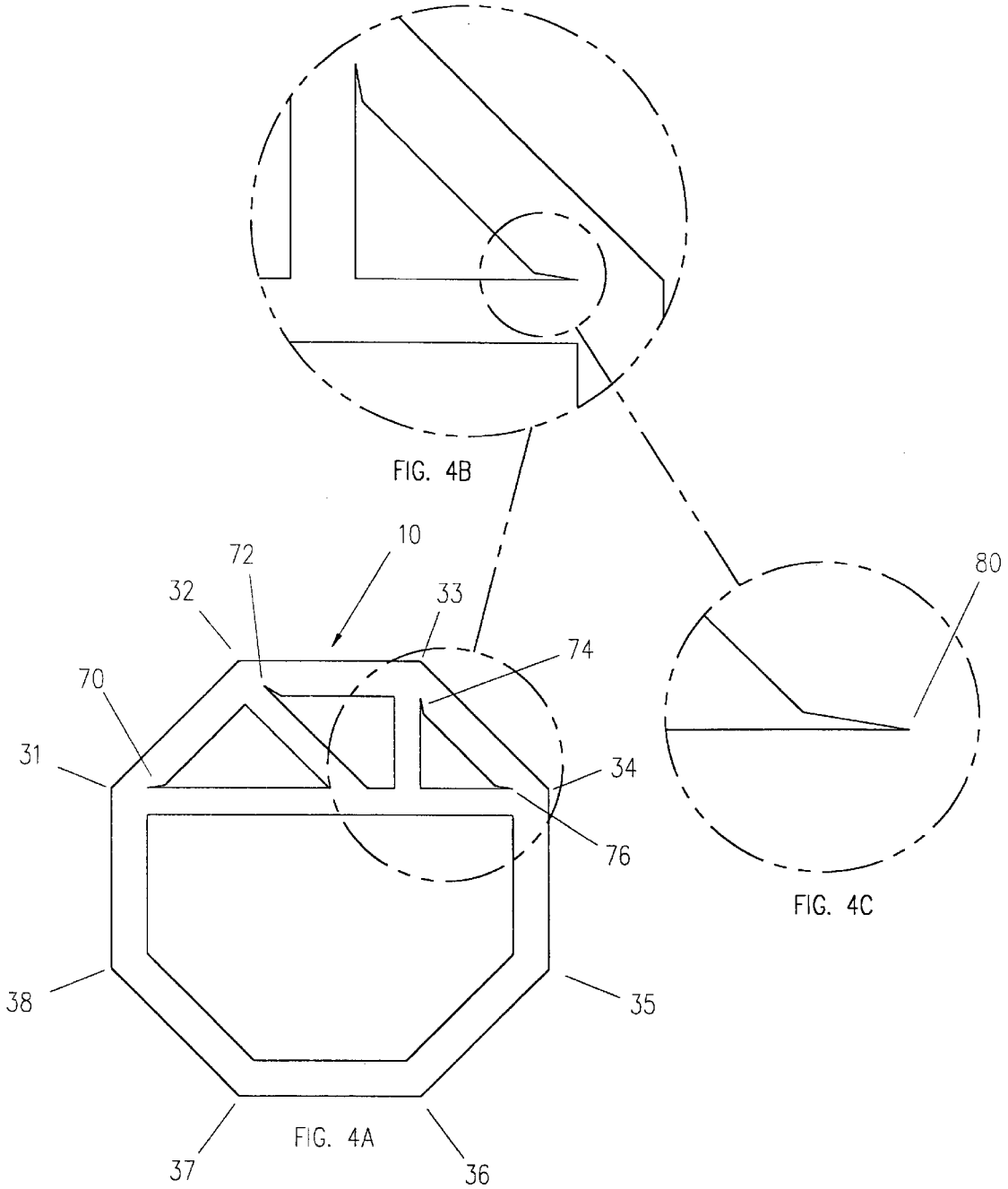
FIG. 4A is a top view of the octagonal building block illustrating the four break away points.
FIG. 4B is an enlarged partial top view of the octagonal building block illustrating two of the break away points.
FIG. 4C is an enlarged view of one of the break away points.
Figure 5A:
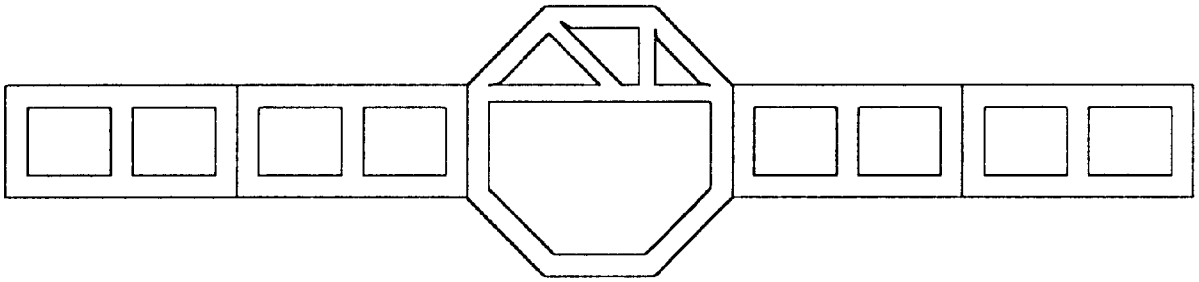
FIG. 5A is a perspective view of a column built into the middle of a wall using the octagonal building block.
Figure 5B:
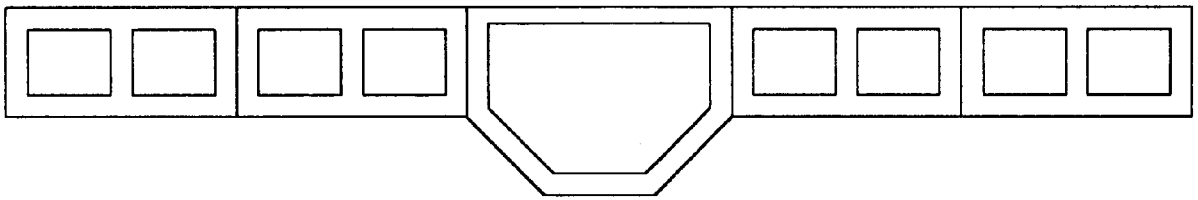
FIG. 5B is a perspective view of a column built into the middle of a wall using the octagonal building after it has been cleaved to reveal the 180° surface of the octagonal block.
Figure 6A:
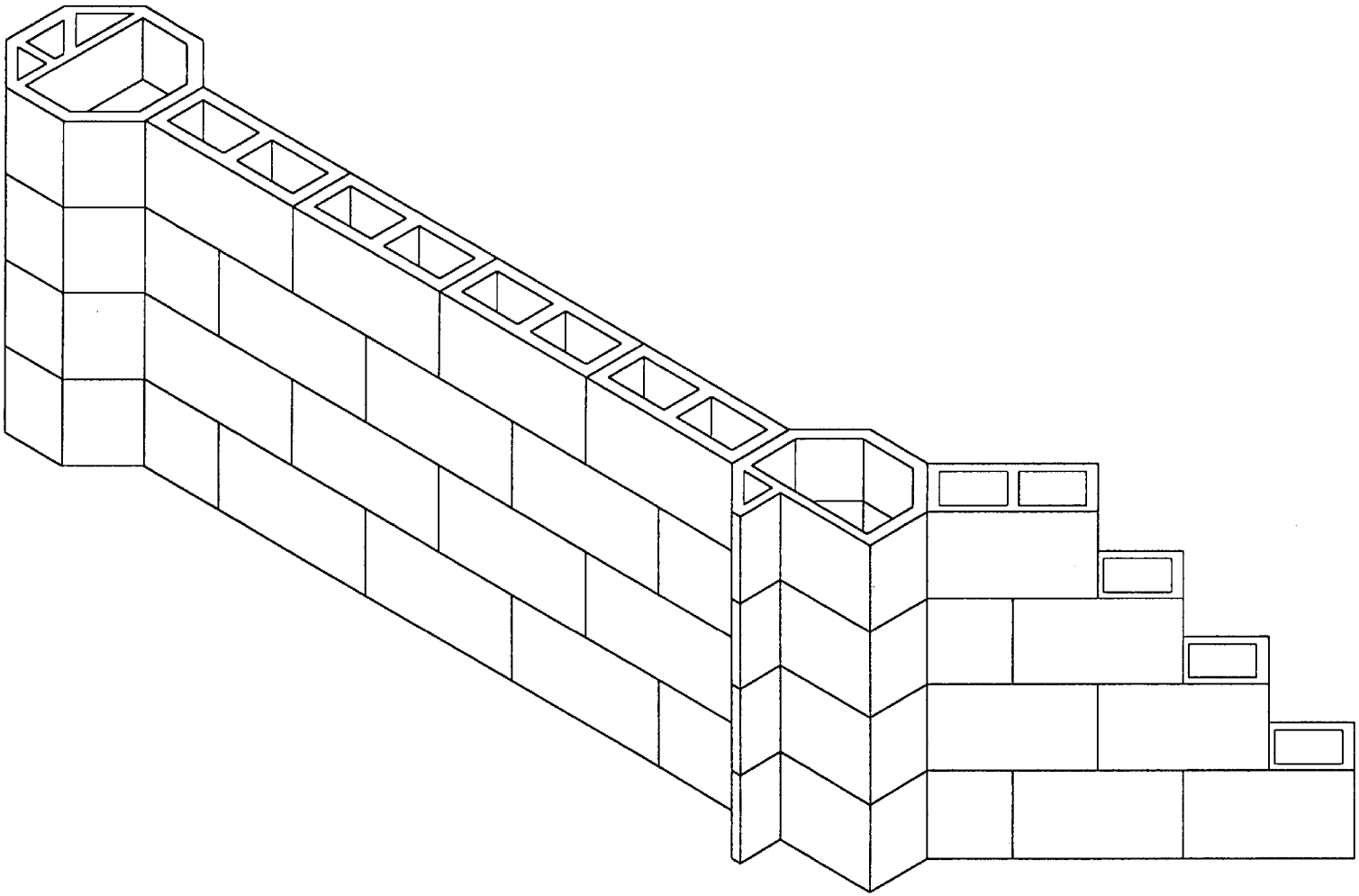
FIG. 6A is a perspective view illustrating the octagonal block integrated into the construction of a wall at various positions.
Figure 6B:
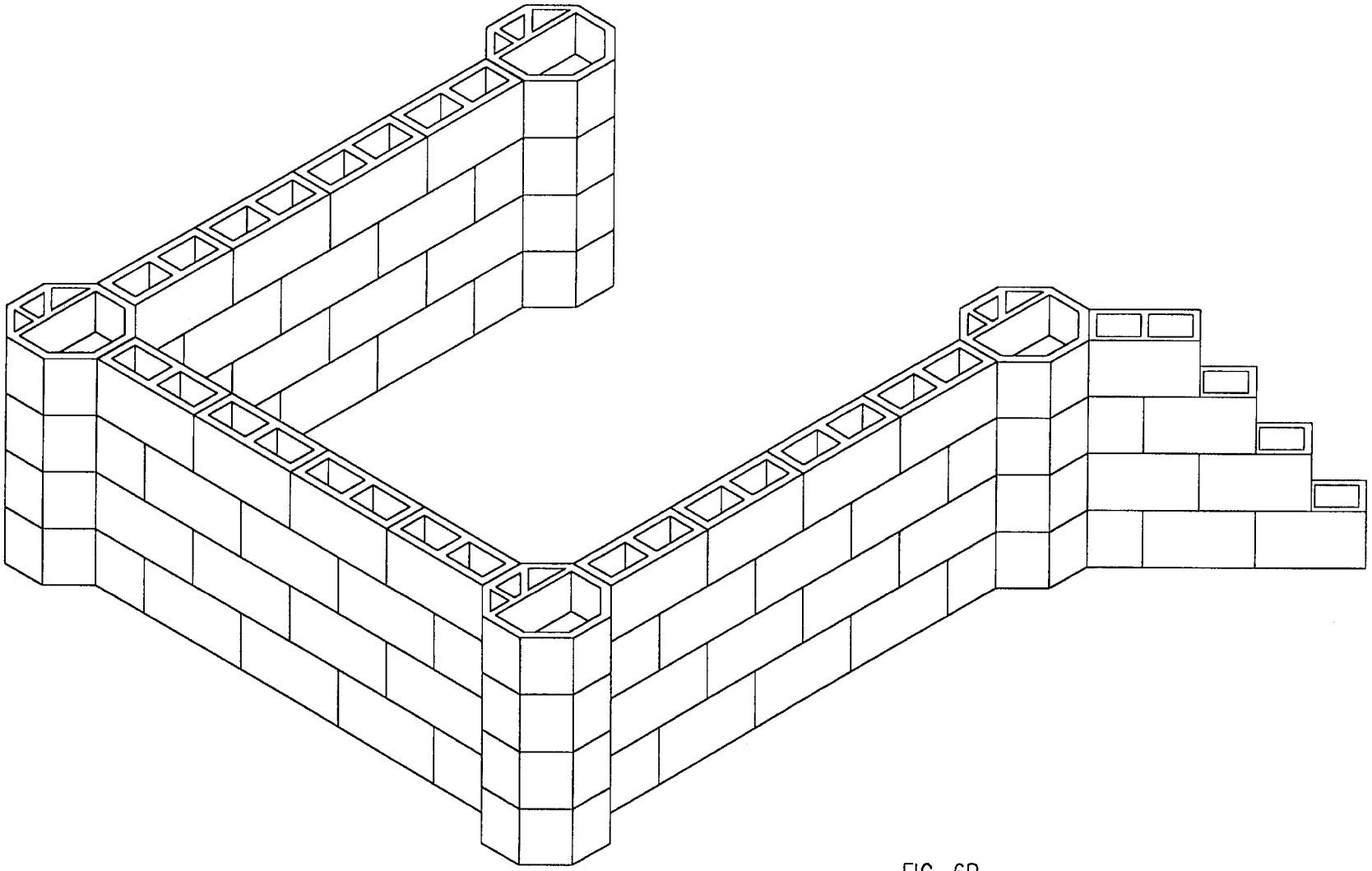
FIG. 6B is a perspective view illustrating the octagonal block integrated into the construction of a wall at various positions.

As shown in FIG. 4A, a first break away point 70 is positioned at said first corner 31; a second break away point 72, is positioned at said second corner 32; a third break away point 74 is positioned at said third corner 33; and a fourth break away point 76 is positioned at said fourth corner 34 whereby said break away points respectively assist in the quick and accurate removal of the appropriate segment as shown hereinabove.

As shown in FIG. 4C, each of said break away points 70, 72, 74, and 76 have a pointed edge 80 to allow a skilled mason to locate and strike upon said pointed edge 80 thereby assisting in the removal of the appropriate segment.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Now that the invention has been described, what is claimed is:

What is claimed is:

1. An octagonal building block, comprising in combination:

first through eighth external side portions respectively connected end-to-end to define an octagonal shape with respective first through eighth corners;

a transverse chord portion extending from said first corner to said fourth corner;

a perpendicular segment portion extending perpendicularly from said transverse chord portion to said third corner defining a right angled cutout;

an angled segment portion extending from said second corner to said transverse chord portion defining a triangle cutout; and a middle cutout defined by said triangle cutout, said right angle cutout and said transverse cord portion.

2. The octagonal building block as set forth in claim 1, wherein said external side portions are of equal length and wherein each of the angles of said corners are equal to 135 degrees.

3. The octagonal building block as set forth in claim 1, wherein said side portions are equal in length to the standard width of conventional rectangular building blocks allowing the placement of said conventional blocks at angles of 0°, 45°, 90°, 135°, 180°, 225°, 270°, and 315° to said octagonal building block.

4. The octagonal building block as set forth in claim 1, wherein said octagonal building block is integrally formed.

5. The octagonal building block as set forth in claim 1, wherein said octagonal building block is formed of concrete.

6. The octagonal building block as set forth in claim 1, further comprising at least one break away point.

7. The octagonal building block as set forth in claim 6, wherein said triangle cutout having at least one break away point.

8. The octagonal building block as set forth in claim 6, wherein said middle cutout having at least one break away point.

9. The octagonal building block as set forth in claim 6, wherein said right angle cutout having at least one break away point.

* * * * *